US011523471B2

(12) United States Patent
Cadima

(10) Patent No.: US 11,523,471 B2
(45) Date of Patent: Dec. 6, 2022

(54) COIL HEATING ELEMENT WITH A TEMPERATURE SENSOR SHIELD

(71) Applicant: Haier US Appliance Solutions, Inc., Wilmington, DE (US)

(72) Inventor: Paul Bryan Cadima, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 495 days.

(21) Appl. No.: 16/585,143

(22) Filed: Sep. 27, 2019

(65) Prior Publication Data

US 2021/0100073 A1 Apr. 1, 2021

(51) Int. Cl.

| | |
|---|---|
| ***H05B 3/20*** | (2006.01) |
| ***H05B 3/74*** | (2006.01) |
| ***F24C 15/10*** | (2006.01) |
| ***H05B 1/02*** | (2006.01) |
| ***H05B 3/76*** | (2006.01) |

(52) U.S. Cl.

CPC ..... *H05B 3/748* (2013.01); *F24C 15/105* (2013.01); *H05B 1/0213* (2013.01); *H05B 1/0266* (2013.01); *H05B 3/76* (2013.01)

(58) Field of Classification Search

CPC ..... F24C 15/105; F24C 7/083; H05B 1/0213; H05B 1/0266; H05B 2213/07; H05B 3/748; H05B 3/76

USPC ..... 219/443.1–468.2

See application file for complete search history.

(56) References Cited

U.S. PATENT DOCUMENTS

| | | | | | |
|---|---|---|---|---|---|
| 2,524,506 | A | * | 10/1950 | Akeley | H05B 1/0213 314/63 |
| 2,994,758 | A | * | 8/1961 | Kelly | H05B 1/0213 219/494 |
| 3,041,437 | A | * | 6/1962 | Carissimi | H05B 1/0213 219/448.16 |
| 3,083,287 | A | * | 3/1963 | Clapp | H01H 37/14 337/44 |
| 3,246,122 | A | * | 4/1966 | Wetzel | F24C 15/105 219/464.1 |
| 4,241,289 | A | * | 12/1980 | Bowling | F24C 15/105 374/165 |
| 4,812,624 | A | | 3/1989 | Kern | |
| 6,246,033 | B1 | | 6/2001 | Shah | |
| 6,753,509 | B2 | | 6/2004 | Gratz et al. | |
| 2018/0238559 | A1 | | 8/2018 | Pasqual et al. | |

FOREIGN PATENT DOCUMENTS

| | | | |
|---|---|---|---|
| GB | 2414559 B | | 8/2007 |
| JP | 2016003786 | * | 1/2016 |

* cited by examiner

*Primary Examiner* — Sang Y Paik
(74) *Attorney, Agent, or Firm* — Dority & Manning, P.A.

(57) ABSTRACT

An electric resistance heating coil assembly includes a spiral wound sheathed heating element having a first coil section and a second coil section. A bimetallic thermostat is connected in series between the first and second coil sections of the spiral wound sheathed heating element. The bimetallic thermostat is spring loaded such that a distal end of the bimetallic thermostat is urged away from a top surface of the spiral wound sheathed heating element. The electric resistance heating coil assembly also includes a shroud cover and a heat transfer disk.

19 Claims, 7 Drawing Sheets

COIL HEATING ELEMENT WITH A TEMPERATURE SENSOR SHIELD

FIELD OF THE INVENTION

The present subject matter relates generally to electric coil heating elements for appliances.

BACKGROUND OF THE INVENTION

Recent regulatory requirements mandate that electric coil heating elements on cooktop appliances be incapable of heating cooking oil to an oil ignition temperature. Thus, certain electric coil heating elements utilize a bimetallic thermostat to interrupt power to the coil when the thermostat reaches a tripping point. In some cooktops, the thermostat is remotely positioned from the cookware and infers the cookware temperature through correlation. In other cooktops, the thermostat contacts a bottom of the cookware to improve correlation. However, whether remotely positioned from the cookware or contacting the cookware, imperfect correlation requires conservative thermostat calibrations and thus results in reduced performance.

Known bimetallic thermostats have shortcomings. In particular, the flatness of the coil has a significant impact to system performance, as does the flatness of the bottom of the cookware. Poor contact between the cookware and the coil cause the portions of the coil that have poor conduction to the cookware to glow red hot and radiate heat. Radiative heat transfer from the coil to the thermostat can overcome the heat transfer from the cookware to the thermostat, causing the thermostat to trip prematurely.

BRIEF DESCRIPTION OF THE INVENTION

Aspects and advantages of the invention will be set forth in part in the following description, or may be apparent from the description, or may be learned through practice of the invention.

In an example embodiment, an electric resistance heating coil assembly includes a spiral wound sheathed heating element having a first coil section and a second coil section. The electric resistance heating coil assembly also includes a shroud cover. A bimetallic thermostat is mounted to the shroud cover and is connected in series between the first and second coil sections of the spiral wound sheathed heating element. The bimetallic thermostat is spring loaded such that a distal end of the bimetallic thermostat is urged away from a top surface of the spiral wound sheathed heating element. The distal end of the bimetallic thermostat is positioned above the shroud cover. A heat transfer disk is positioned on the bimetallic thermostat at the distal end of the bimetallic thermostat. A diameter of the heat transfer disk is greater than a diameter of the bimetallic thermostat, and the diameter of the heat transfer disk is less than a diameter of the center of the spiral wound sheathed heating element. The shroud cover defines a plurality of thermal breaks around the bimetallic thermostat. The plurality of thermal breaks limits thermal conduction between the shroud cover and the bimetallic thermostat.

In another example embodiment, an electric resistance heating coil assembly includes a spiral wound sheathed heating element having a first coil section and a second coil section. The electric resistance heating coil assembly also includes a shroud cover. A bimetallic thermostat is mounted to the shroud cover and is connected in series between the first and second coil sections of the spiral wound sheathed heating element. The bimetallic thermostat is spring loaded such that a distal end of the bimetallic thermostat is urged away from a top surface of the spiral wound sheathed heating element. The distal end of the bimetallic thermostat is positioned above the shroud cover. A heat transfer disk is positioned on the bimetallic thermostat at the distal end of the bimetallic thermostat. The heat transfer disk is positioned concentrically with a center of the spiral wound sheathed heating element. A diameter of the heat transfer disk is greater than a diameter of the bimetallic thermostat, and the diameter of the heat transfer disk is less than a diameter of the center of the spiral wound sheathed heating element. The shroud cover defines a plurality of thermal breaks around the bimetallic thermostat. The plurality of thermal breaks extend through the shroud cover such that air is flowable through the shroud cover in the plurality of thermal breaks. The shroud cover defines a circular emboss positioned below the heat transfer disk. The circular emboss extends around the plurality of thermal breaks.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
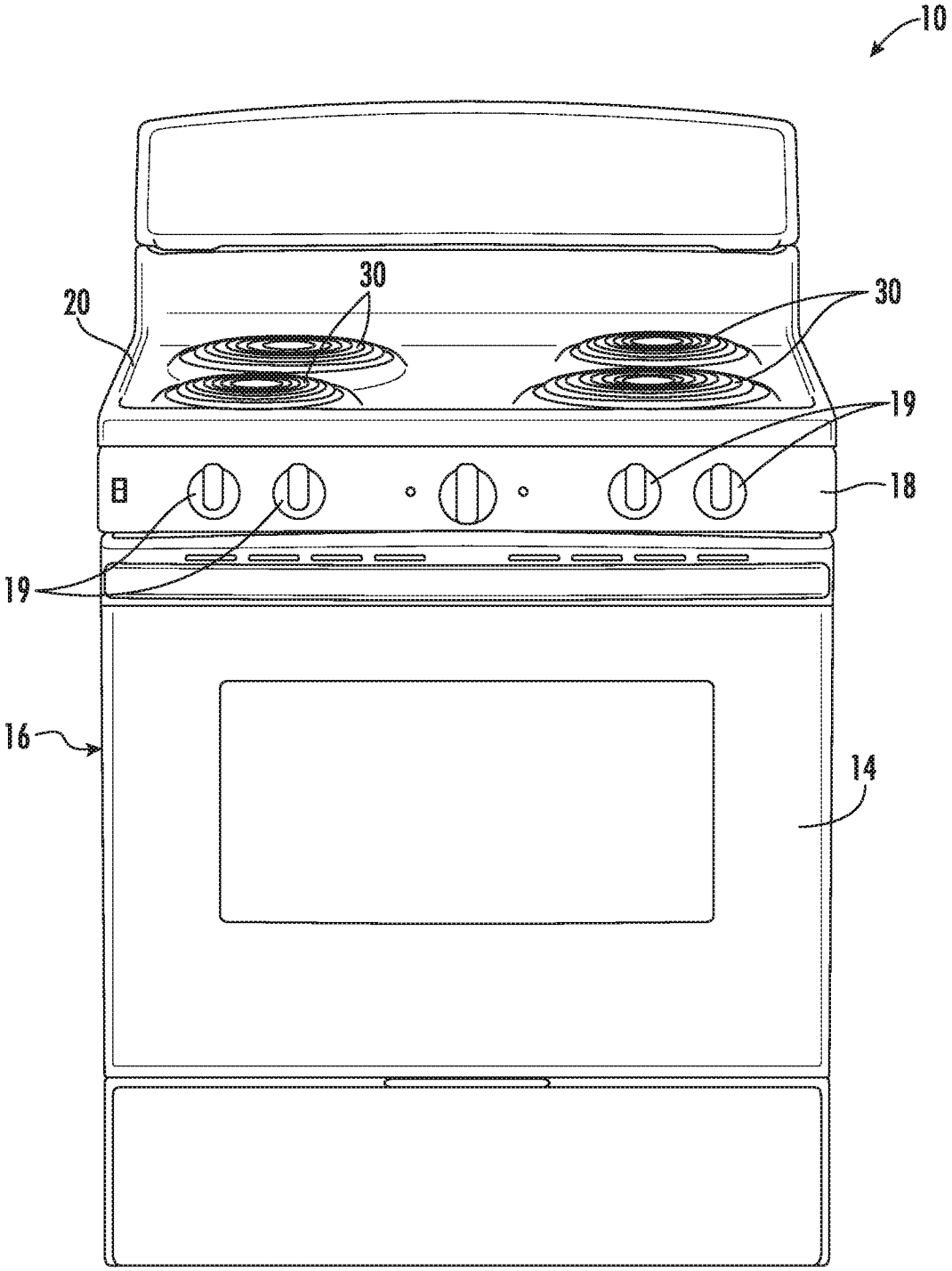
FIG. 1 is a front, perspective view of a range appliance according to an example embodiment.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a front, perspective view of a range appliance 10 according to an example embodiment. Range appliance 10 is provided by way of example only and is not intended to limit the present subject matter to the particular arrangement shown in FIG. 1. Thus, e.g., the present subject matter may be used with other cooktop appliance configurations, e.g., double oven range appliances, standalone cooktop appliances, etc.

A top panel 20 of range appliance 10 includes heating elements 30. Heating elements 30 may be, e.g., electrical resistive heating elements. Range appliance 10 may include only one type of heating element 30, or range appliance 10 may include a combination of different types of heating elements 30, such as a combination of electrical resistive heating elements and gas burners. Further, heating elements 30 may have any suitable shape and size, and a combination of heating elements 30 of different shapes and sizes may be used.

A cooking utensil, such as a pot, pan, or the like, may be placed on heating elements 30 to cook or heat food items placed in the cooking utensil. Range appliance 10 also includes a door 14 that permits access to a cooking chamber 16 of range appliance 10, e.g., for cooking or baking of food items therein. A control panel 18 having controls 19 permits a user to make selections for cooking of food items; although shown on a front panel of range appliance 10, control panel 18 may be positioned in any suitable location. Controls 19 may include buttons, knobs, and the like, as well as combinations thereof. As an example, a user may manipulate one or more controls 19 to select a temperature and/or a heat or power output for each heating element 30.

FIGS. 2 through 7 show an electric resistance heating coil assembly 100 of range appliance 10. Electric resistance heating coil assembly 100 may be used as one or more of heating elements 30 in range appliance 10. However, while described in greater detail below in the context of range appliance 10, it will be understood that electric resistance heating coil assembly 100 may be used in or with any suitable cooktop appliance in alternative example embodiments. As discussed in greater detail below, electric resistance heating coil assembly 100 includes features for limiting undesirable heat transfer to a bimetallic thermostat 120 and/or for facilitating conductive heat transfer between bimetallic thermostat 120 and a utensil positioned on electric resistance heating coil assembly 100.

Figure 2:
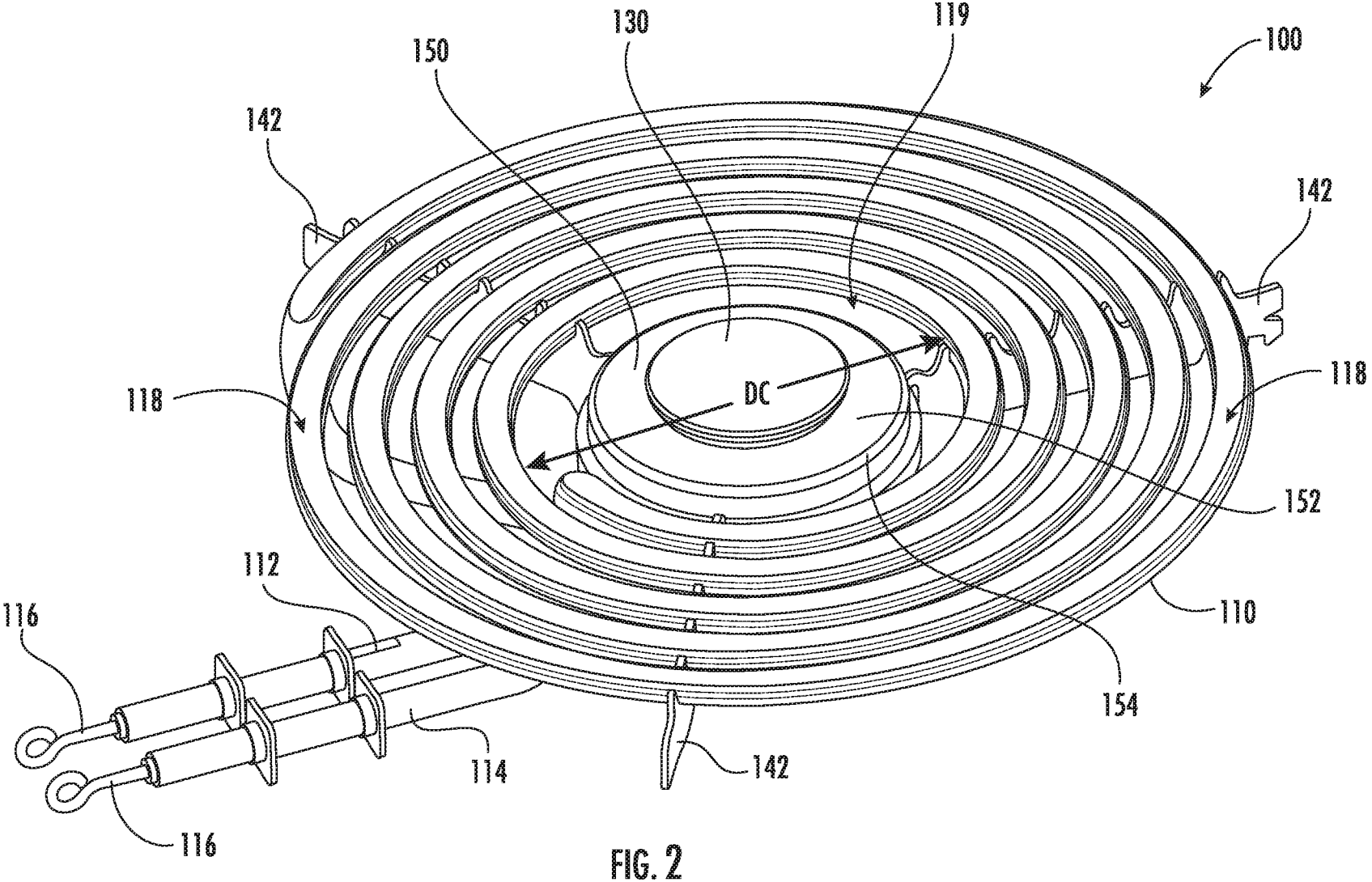
FIG. 2 is a top, perspective view of an electric resistance heating coil assembly of the example range appliance of FIG. 1.

As shown in FIG. 2, electric resistance heating coil assembly 100 includes a spiral wound sheathed heating element 110. Spiral wound sheathed heating element 110 has a first coil section 112 and a second coil section 114. Spiral wound sheathed heating element 110 also has a pair of terminals 116. Each of first and second coil sections 112, 114 is directly coupled or connected to a respective terminal 116. A voltage differential across terminals 116 induces an electrical current through spiral wound sheathed heating element 110, and spiral wound sheathed heating element 110 may increase in temperature by resisting the electrical current through spiral wound sheathed heating element 110.

Bimetallic thermostat 120 (FIG. 3) is connected in series between first and second coil sections 112, 114 of spiral wound sheathed heating element 110. Bimetallic thermostat 120 opens and closes in response to a temperature of bimetallic thermostat 120. For example, bimetallic thermostat 120 may be spring loaded such that a distal end 122 of bimetallic thermostat 120 is urged away from a top surface 118 of spiral wound sheathed heating element 110. Thus, distal end 122 of bimetallic thermostat 120 may be urged towards a utensil (not shown) positioned on top surface 118 of spiral wound sheathed heating element 110. Bimetallic thermostat 120 may measure the temperature of the utensil on top surface 118 of spiral wound sheathed heating element 110 due to heat transfer between the utensil and bimetallic thermostat 120. As discussed in greater detail below, electric resistance heating coil assembly 100 includes features for facilitating conductive heat transfer between the utensil on top surface 118 of spiral wound sheathed heating element 110 and bimetallic thermostat 120 and/or for limiting radiative heat transfer from spiral wound sheathed heating element 110 to bimetallic thermostat 120.

Figure 3:
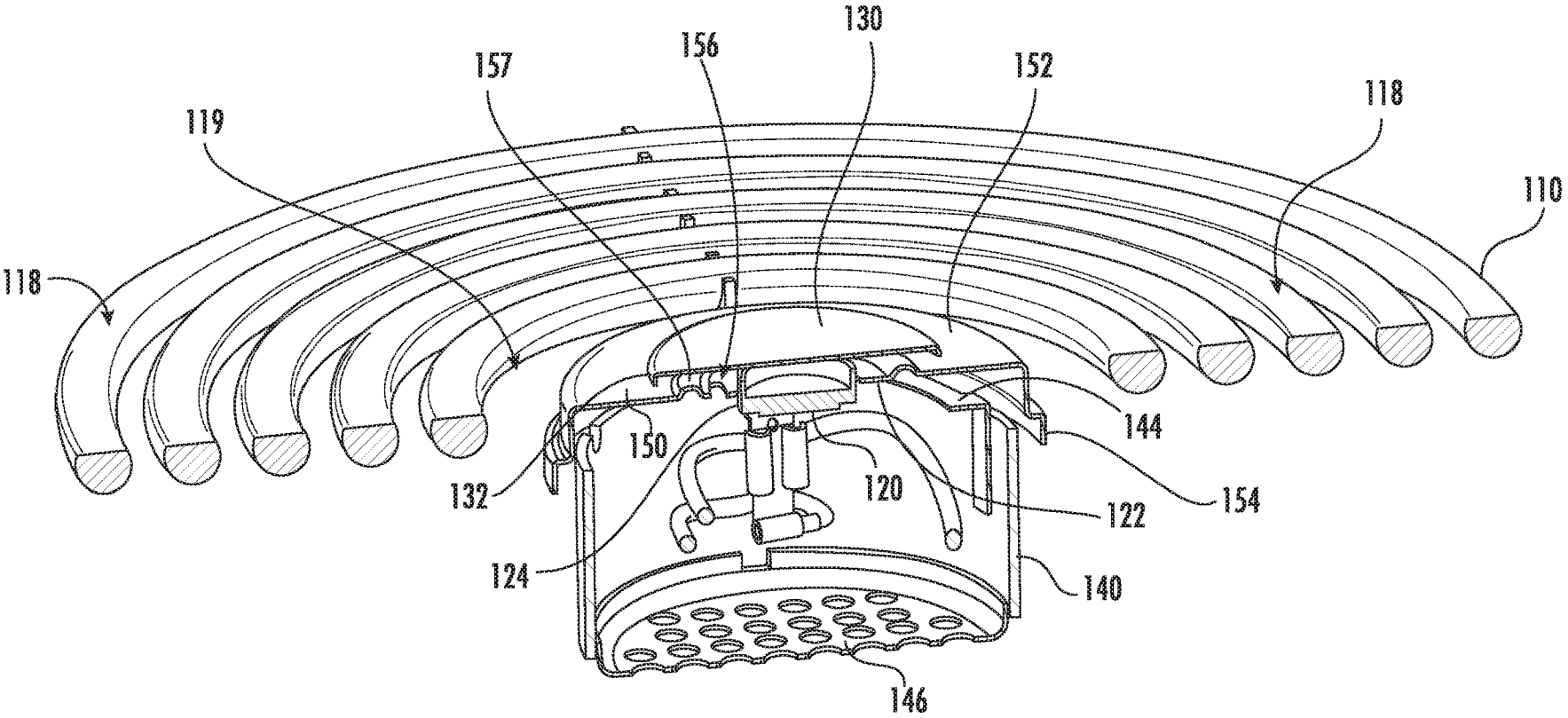
FIG. 3 is a section view of the electric resistance heating coil assembly of FIG. 2.
Figure 4:
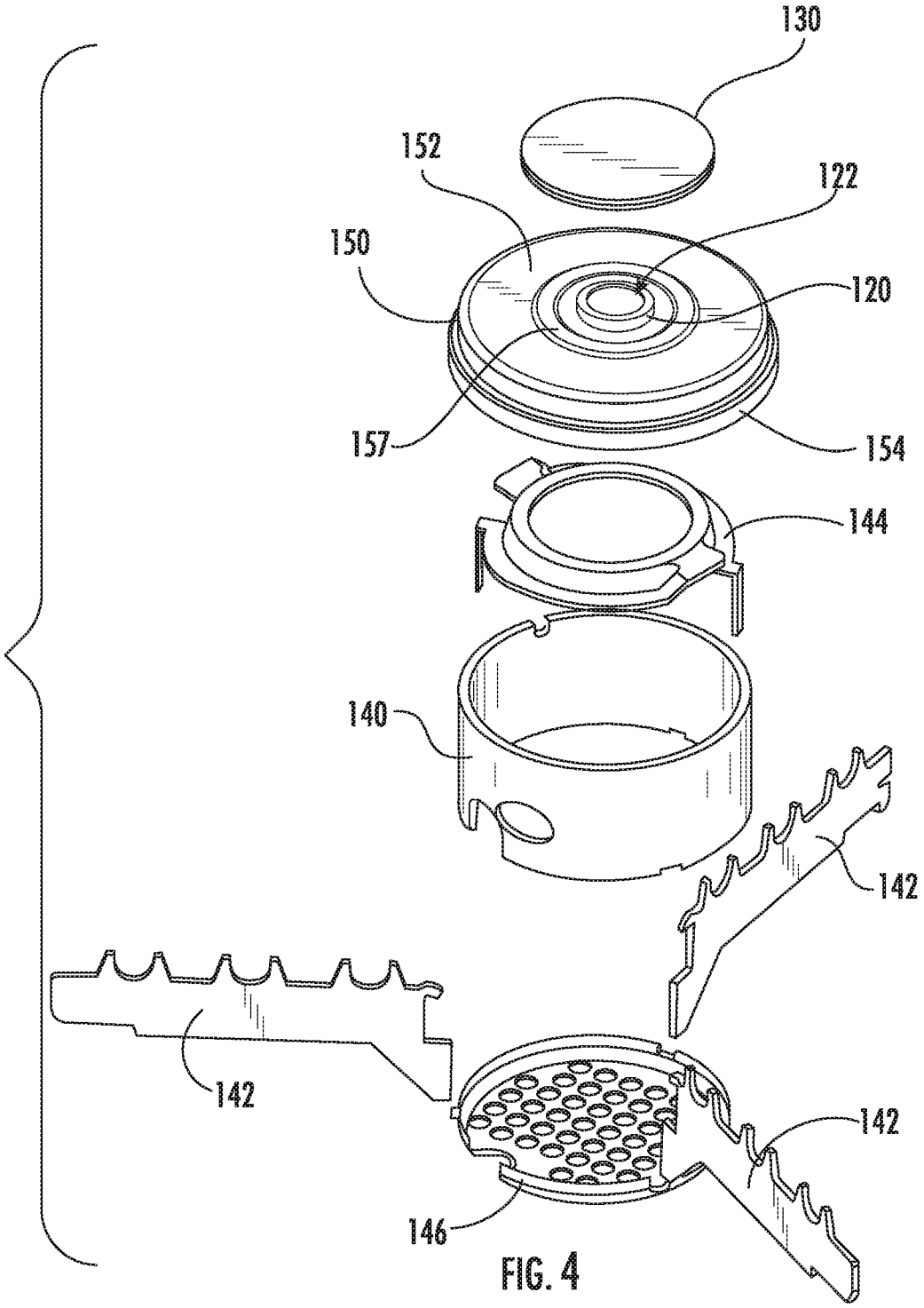
FIG. 4 is an exploded view of certain components of the electric resistance heating coil assembly of FIG. 2.

As shown in FIGS. 2 through 4, electric resistance heating coil assembly 100 may include a shroud 140 and coil support arms 142. Coil support arms 142 extend, e.g., radially, from shroud 140, and spiral wound sheathed heating element 110 is positioned on and supported by coil support arms 142. Coil support arms 142 may rest on top panel 20 to support electric resistance heating coil assembly 100 on top panel 20. Bimetallic thermostat 120 may be mounted to a shroud cover 150, e.g., on a top wall 152 of shroud cover 150. Distal end 122 of bimetallic thermostat 120 may be positioned above shroud cover 150. Thus, distal end 122 of bimetallic thermostat 120 may extend through top wall 152 of shroud cover 150. A spring 144 biases shroud cover 150 and bimetallic thermostat 120 thereon upwardly. Shroud cover 150 may extend over shroud 140. In particular, a top of shroud 140 may be nested in shroud cover 150, e.g., within a flange 154 that extends downwardly from top wall 152 of shroud cover 150.

As shown in FIGS. 3 through 7, shroud cover 150 defines a plurality of thermal breaks 156 around bimetallic thermostat 120. Thermal breaks 156 limit thermal conduction between shroud cover 150 and bimetallic thermostat 120. For example, shroud cover 150, e.g., flange 154 of shroud cover 150, may be positioned radially between spiral wound sheathed heating element 110 and bimetallic thermostat 120. Thus, shroud cover 150 may block radiative heat transfer between spiral wound sheathed heating element 110 and bimetallic thermostat 120. Shroud cover 150 may increase in temperature during operation of spiral wound sheathed heating element 110. However, thermal breaks 156 may limit heat transfer between bimetallic thermostat 120 and shroud cover 150 and thereby improve performance of bimetallic thermostat 120. In particular, bimetallic thermostat 120 more accurately measures or senses the temperature of a utensil on top surface 118 of spiral wound sheathed heating element 110 by reducing heat transfer from spiral wound sheathed heating element 110 to bimetallic thermostat 120 compared to known heating elements.

Thermal breaks 156 may be holes, slots, etc. that extend through top wall 152 of shroud cover 150. Thus, thermal breaks 156 may form radial discontinuities in top wall 152 of shroud cover 150 that limit conductive heat transfer between bimetallic thermostat 120 and shroud cover 150. Thermal breaks 156 may also extend through shroud cover 150 such that air is flowable through shroud cover 150 via thermal breaks 156. For example, air may flow upwardly from below electric resistance heating coil assembly 100 and enter shroud 140 through a perforated plate 146. Such upwardly flowing air may pass through shroud 140 to shroud cover 150 and then pass through shroud cover 150 at thermal breaks 156. Such air flow may cool bimetallic thermostat 120 and assist with limiting heat transfer between bimetallic thermostat 120 and shroud cover 150 (e.g., and other components of electric resistance heating coil assembly 100).

Figure 6:
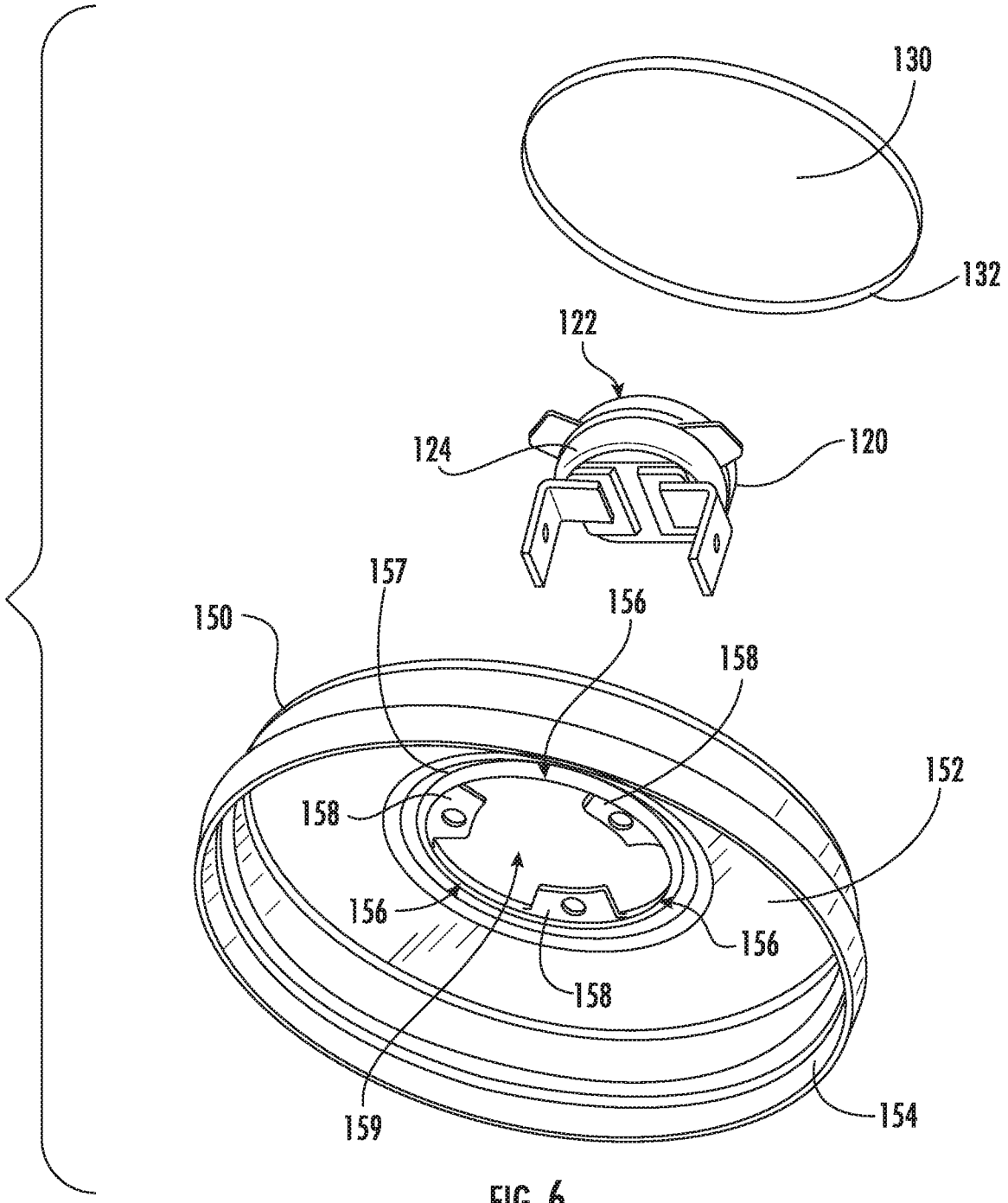
FIG. 6 is an exploded view of the shroud disk, the heat transfer disk, and the bimetallic thermostat of FIG. 5.
Figure 7:
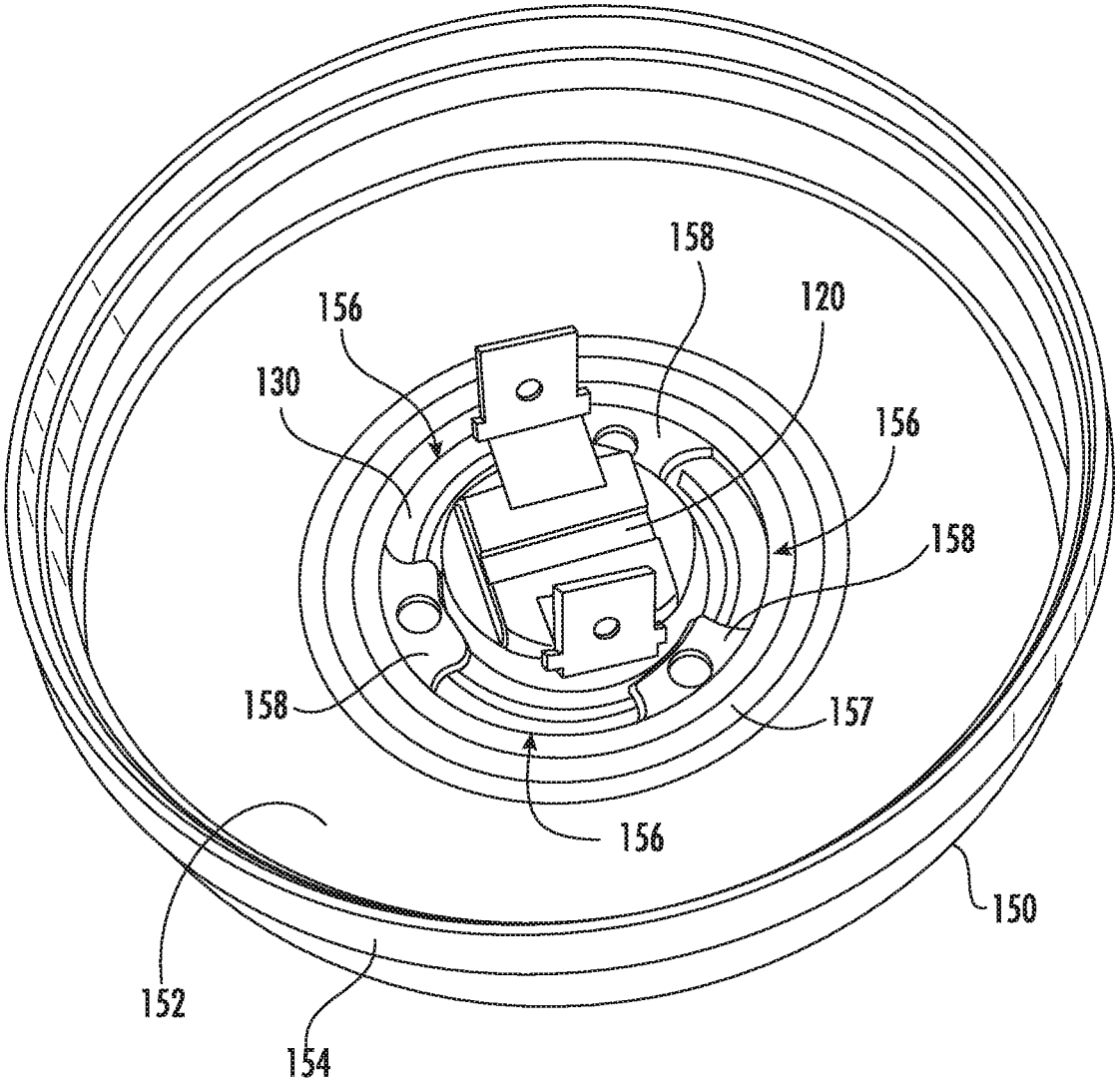
FIG. 7 is a bottom, perspective view of the shroud disk, the heat transfer disk, and the bimetallic thermostat of FIG. 5.

As shown in FIG. 6, shroud cover 150 may include a plurality of fingers 158, e.g., on top wall 152 of shroud cover 150. Fingers 158 may be positioned at a central opening 159 of shroud cover 150 and may extend, e.g., radially, into central opening 159. Fingers 158 may also be, e.g., circumferentially, distributed around central opening 159. Bimetallic thermostat 120 is supported on fingers 158. For example, fingers 158 may extend radially into central opening 159 to bimetallic thermostat 120, and bimetallic thermostat 120 may rest and/or be mounted to fingers 158. Each thermal break 156 may be positioned, e.g., circumferentially, between a respective pair of fingers 158. Thus, e.g., fingers 158 may be separated from each other by thermal breaks 156 and vice versa. Fingers 158 may also have holes (not labeled, but shown in FIG. 6) that extend through fingers 158 to form additional thermal breaks 156 and further facilitate limiting conductive heat transfer between bimetallic thermostat 120 and shroud cover 150

Figure 5:
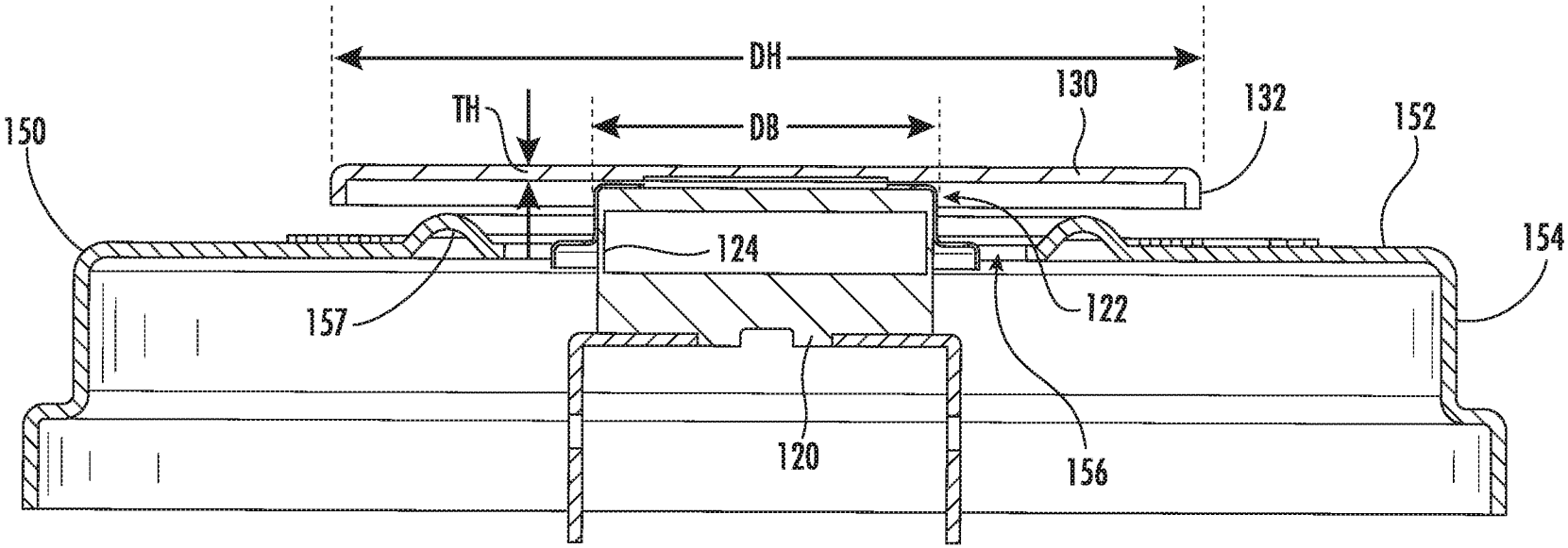
FIG. 5 is a section view of a shroud disk, a heat transfer disk, and a bimetallic thermostat of the electric resistance heating coil assembly of FIG. 2.

As shown in FIGS. 4 and 5, shroud cover 150 may also include a circular emboss 157. Circular emboss 157 may be formed by stamping and/or molding top wall 152 of shroud cover 150. Circular emboss 157 may extend, e.g., circumferentially, around thermal breaks 156 and/or bimetallic thermostat 120, and thermal breaks 156 and/or bimetallic thermostat 120 may be positioned radially inward of circular emboss 157. Circular emboss 157 may also extend upwardly, e.g., from top wall 152. Thus, circular emboss 157 may block, e.g., radially inward, liquid flow on shroud cover 150 to thermal breaks 156 and/or bimetallic thermostat 120 such that the liquid does not pass through shroud cover 106 at such locations.

As may be seen from the above, electric resistance heating coil assembly 100 advantageously obstructs heat transfer between spiral wound sheathed heating element 110 and bimetallic thermostat 120. In particular, electric resistance heating coil assembly 100 includes shroud 140, shroud cover 150, and thermal breaks 156 that advantageously limit heat transfer between spiral wound sheathed heating element 110 and bimetallic thermostat 120. Thermal breaks 156 also allow cooling air flow across bimetallic thermostat 120, shroud 140, and shroud cover 150. Such features assist bimetallic thermostat 120 with more accurately measuring or sensing a temperature of a utensil on top surface 118 of spiral wound sheathed heating element 110 compared to known sensor arrangements. Electric resistance heating coil assembly 100 also reduces a maximum temperature of internal electrical contacts of bimetallic thermostat 120, which allows for lower cost materials to be used within bimetallic thermostat 120. In addition, bimetallic thermostat 120 has a reduced cycle time after tripping compared to known sensor arrangements due to the cooling air flow through thermal breaks 156.

As shown in FIGS. 2 through 6, electric resistance heating coil assembly 100 includes a heat transfer disk 130. Heat transfer disk 130 is positioned on bimetallic thermostat 120 at distal end 122 of bimetallic thermostat 120. For example, heat transfer disk 130 may contact distal end 122 of bimetallic thermostat 120. Thus, heat transfer disk 130 may be in direct thermal conductive communication with bimetallic thermostat 120. Because heat transfer disk 130 is positioned at distal end 122 of bimetallic thermostat 120, heat transfer disk 130 may also be urged away from top surface 118 of spiral wound sheathed heating element 110. In particular, heat transfer disk 130 may be urged against the utensil on top surface 118 of spiral wound sheathed heating element 110 due to the spring loading of bimetallic thermostat 120.

Heat transfer disk 130 may be formed of aluminum, copper, a copper alloy, or an aluminum alloy. Such materials advantageously facilitate conductive heat transfer between the utensil on top surface 118 of spiral wound sheathed heating element 110 and heat transfer disk 130. In certain example embodiments, a casing 124 (FIG. 6) of bimetallic thermostat 120 and heat transfer disk 130 may be formed from a common material, such as one of aluminum, copper, a copper alloy, or an aluminum alloy, in order to advantageously facilitate conductive heat transfer between casing 124 and heat transfer disk 130.

Heat transfer disk 130 and/or bimetallic thermostat 120 may be positioned concentrically with a center 119 of spiral wound sheathed heating element 110. Center 119 of spiral wound sheathed heating element 110 may be open, and spiral wound sheathed heating element may extend circumferentially around heat transfer disk 130 and/or bimetallic thermostat 120 at center 119. Heat transfer disk 130 may also cover distal end 122 of bimetallic thermostat 120. Thus, heat transfer disk 130 may be positioned between bimetallic thermostat 120 and a utensil on top surface 118 of spiral wound sheathed heating element 110, and heat transfer disk 130 may contact the utensil. In addition, due to the sizing of heat transfer disk 130 relative to bimetallic thermostat 120, heat transfer disk 130 may block fluid flow through top panel 20 at bimetallic thermostat 120. For example, heat transfer disk 130 may extend radially from bimetallic thermostat 120 over top wall 152 of shroud cover 150. Thus, e.g., liquid flowing downwardly onto heat transfer disk 130 may flow radially away from bimetallic thermostat 120 and thermal breaks 152, e.g., such that the liquid does not pass through shroud cover 150 at thermal breaks 152. Heat transfer disk 130 may also include a flange 132 that extends downwardly towards shroud cover 150 to assist with managing liquid flow off heat transfer disk 130. Circular emboss 157 may be positioned below heat transfer disk 130 on shroud cover 150 to further assist such liquid flow management.

FIG. 5 is a section view of heat transfer disk 130 and bimetallic thermostat 120. As discussed in greater detail below, heat transfer disk 130 may be sized to facilitate conductive heat transfer between a utensil on top surface 118 of spiral wound sheathed heating element 110 and bimetallic thermostat 120. For example, a diameter DH of heat transfer disk 130 may be no less than two times greater than a diameter DB of bimetallic thermostat 120, e.g., in a plane that is perpendicular to vertical. In addition, the diameter DH of heat transfer disk 130 may be less than a diameter DC (FIG. 2) of center 119 of spiral wound sheathed heating element 110. As may be seen from the above, the diameter DH of heat transfer disk 130 may be significantly greater than the diameter DB of bimetallic thermostat 120. Such sizing of heat transfer disk 130 relative to bimetallic thermostat 120 advantageously assists conductive heat transfer from the utensil on top surface 118 of spiral wound sheathed heating element 110 to bimetallic thermostat 120.

In certain example embodiments, the diameter DH of heat transfer disk 130 may be no less than one inch (1") and no greater than one and a half inches (1.5"). Conversely, a thickness TH of heat transfer disk 130, e.g., that is perpendicular to the diameter DH of heat transfer disk 130, may be no less than two hundredths of an inch (0.02") and no greater than five hundredths of an inch (0.05"). In addition, a ratio of the diameter DH of heat transfer disk 130 to the thickness TH of heat transfer disk 130 may be no less than twenty (20) and no greater than seventy-five (75) Such sizing of heat transfer disk 130 advantageously assists conductive heat transfer from the utensil on top surface 118 of spiral wound sheathed heating element 110 to bimetallic thermostat 120.

As noted above, heat transfer disk 130 may be in direct thermal conductive communication with bimetallic thermostat 120. To provide direct thermal conductive communication between bimetallic thermostat 120 and heat transfer disk 130, heat transfer disk 130 may be spot welded, seam welded, ultrasonic welded or resistance welded to bimetallic thermostat 120. It will be understood that other connections between bimetallic thermostat 120 and heat transfer disk 130 also provide direct thermal conductive communication. For example, heat transfer disk 130 may be integrally formed with casing 124 of bimetallic thermostat 120. Thus, casing 124 of bimetallic thermostat 120 and heat transfer disk 130 may be formed from a single, continuous piece of material, such as aluminum, copper, a copper alloy, or an aluminum alloy. As another example, heat transfer disk 130 may be crimped or pressed onto bimetallic thermostat 120.

As may be seen from the above, heat transfer disk 130 advantageously has increased conductive heat transfer from a utensil on top surface 118 of spiral wound sheathed heating element 110 to bimetallic thermostat 120 relative to known heating elements without heat transfer disk 130. Known heating elements without heat transfer disk 130 have limited ability to transfer heat between a cooking utensil and an associated bimetallic thermostat due to limited contact area between such components, along with varying degrees of contact resistance between the cooking utensil and bimetallic thermostat. Testing has shown that heat transfer disk 130 mounted to bimetallic thermostat 120 at distal end 122 of bimetallic thermostat 120 increases conduction between bimetallic thermostat 120 and cookware on spiral wound sheathed heating element 110. Even under conditions that cause known heating elements to trip before water can boil, electric resistance heating coil assembly 100 runs continuously and without interrupted power. Thus, electric resistance heating coil assembly 100 is advantageously robust to warped coils and bowed pan bottoms, and better tracks the temperature of cookware despite excessive heat transfer from spiral wound sheathed heating element 110.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An electric resistance heating coil assembly, comprising:

a spiral wound sheathed heating element having a first coil section and a second coil section;

a shroud cover with an outer flange and a top wall, the outer flange of the shroud cover extending downwardly from the top wall of shroud cover;

a bimetallic thermostat mounted to the shroud cover at the top wall of the shroud cover and connected in series between the first and second coil sections of the spiral wound sheathed heating element, the bimetallic thermostat spring loaded such that a distal end of the bimetallic thermostat is urged away from a top surface of the spiral wound sheathed heating element, the distal end of the bimetallic thermostat positioned above the shroud cover, the outer flange of the shroud cover positioned radially between the spiral wound sheathed heating element and the bimetallic thermostat; and a heat transfer disk positioned on the bimetallic thermostat at the distal end of the bimetallic thermostat above the top wall of shroud cover, wherein a diameter of the heat transfer disk is greater than a diameter of the bimetallic thermostat, and the diameter of the heat transfer disk is less than a diameter of the center of the spiral wound sheathed heating element, and wherein the top wall of the shroud cover defines a plurality of thermal breaks around the bimetallic thermostat, the plurality of thermal breaks extending through the top wall of the shroud cover in order to limit thermal conduction between the shroud cover and the bimetallic thermostat.

2. The electric resistance heating coil assembly of claim 1, wherein the plurality of thermal breaks extend through the shroud cover such that air is flowable through the shroud cover in the plurality of thermal breaks.

3. The electric resistance heating coil assembly of claim 1, wherein the shroud cover comprises a plurality of fingers positioned at a central opening of the shroud cover, the plurality of fingers distributed around the central opening, the bimetallic thermostat supported on the plurality of fingers.

4. The electric resistance heating coil assembly of claim 3, wherein each thermal break of the plurality of thermal breaks is positioned between a respective pair of the plurality of fingers.

5. The electric resistance heating coil assembly of claim 1, wherein the shroud cover defines a circular emboss that extends around the plurality of thermal breaks.

6. The electric resistance heating coil assembly of claim 5, wherein the circular emboss is positioned below the heat transfer disk.

7. The electric resistance heating coil assembly of claim 1, wherein the heat transfer disk is positioned concentrically with a center of the spiral wound sheathed heating element.

8. The electric resistance heating coil assembly of claim 1, wherein the diameter of the heat transfer disk is no less than two times greater than the diameter of the bimetallic thermostat, and the heat transfer disk is in direct thermal conductive communication with the bimetallic thermostat.

9. The electric resistance heating coil assembly of claim 8, wherein the heat transfer disk is spot welded, seam welded, ultrasonic welded, or resistance welded to the bimetallic thermostat.

10. The electric resistance heating coil assembly of claim 8, wherein the heat transfer disk is crimped or pressed onto the bimetallic thermostat.

11. The electric resistance heating coil assembly of claim 1, wherein the diameter of the heat transfer disk is no less than two times greater than the diameter of the bimetallic thermostat, and the heat transfer disk is integrally formed with a casing of the bimetallic thermostat.

12. The electric resistance heating coil assembly of claim 1, wherein the heat transfer disk is formed of aluminum, copper, a copper alloy, or an aluminum alloy.

13. The electric resistance heating coil assembly of claim 1, wherein the heat transfer disk covers the distal end of the bimetallic thermostat.

14. The electric resistance heating coil assembly of claim 1, wherein a diameter of the heat transfer disk is no less than one inch and no greater than one and a half inches.

15. The electric resistance heating coil assembly of claim 1, wherein a thickness of the heat transfer disk is no less than two hundredths of an inch and no greater than five hundredths of an inch.

16. The electric resistance heating coil assembly of claim 1, wherein a ratio of a diameter of the heat transfer disk to a thickness of the heat transfer disk is no less than twenty and no greater than seventy-five.

17. An electric resistance heating coil assembly, comprising:

a spiral wound sheathed heating element having a first coil section and a second coil section;

a shroud cover with an outer flange and a top wall, the outer flange of the shroud cover extending downwardly from the top wall of shroud cover;

a bimetallic thermostat mounted to the shroud cover at the top wall of the shroud cover and connected in series between the first and second coil sections of the spiral wound sheathed heating element, the bimetallic thermostat spring loaded such that a distal end of the bimetallic thermostat is urged away from a top surface of the spiral wound sheathed heating element, the distal end of the bimetallic thermostat positioned above the shroud cover, the outer flange of the shroud cover positioned radially between the spiral wound sheathed heating element and the bimetallic thermostat; and a heat transfer disk positioned on the bimetallic thermostat at the distal end of the bimetallic thermostat above the top wall of shroud cover, the heat transfer disk positioned concentrically with a center of the spiral wound sheathed heating element, wherein a diameter of the heat transfer disk is greater than a diameter of the bimetallic thermostat, and the diameter of the heat transfer disk is less than a diameter of the center of the spiral wound sheathed heating element, wherein the top wall of the shroud cover defines a plurality of thermal breaks around the bimetallic thermostat, the plurality of thermal breaks extending through the top wall of the shroud cover such that air is flowable through the top wall of the shroud cover in the plurality of thermal breaks, and wherein the top wall of the shroud cover defines a circular emboss positioned below the heat transfer disk, the circular emboss extending around the plurality of thermal breaks.

18. The electric resistance heating coil assembly of claim 17, wherein the shroud cover comprises a plurality of fingers positioned at a central opening of the shroud cover, the plurality of fingers distributed around the central opening, the bimetallic thermostat supported on the plurality of fingers.

19. The electric resistance heating coil assembly of claim 18, wherein each thermal break of the plurality of thermal breaks is positioned between a respective pair of the plurality of fingers.

* * * * *